United States Patent [19]

Remmington

[11] Patent Number: 4,780,402

[45] Date of Patent: Oct. 25, 1988

[54] FILMS OF A LIGHT SENSITIVE ELEMENT HAVING A SUPPORT POLYETHYLENE TEREPHTHALATE CONTAINING BARIUM SULFATE PARTICLES

[75] Inventor: Timothy A. Remmington, Hertfordshire, England

[73] Assignee: Imperial Chemical Industries, PLC, London, England

[21] Appl. No.: 85,227

[22] Filed: Aug. 13, 1987

Related U.S. Application Data

[63] Continuation of Ser. No. 921,817, Oct. 21, 1986, abandoned, which is a continuation of Ser. No. 800,789, Nov. 22, 1985, abandoned, which is a continuation of Ser. No. 444,182, Nov. 24, 1982, abandoned, which is a continuation of Ser. No. 079,563, Sep. 27, 1979, abandoned, which is a continuation of Ser. No. 890,803, Mar. 27, 1978, abandoned, which is a continuation-in-part of Ser. No. 727,217, Sep. 17, 1976, abandoned.

[30] Foreign Application Priority Data

Oct. 23, 1975 [GB] United Kingdom ..... 43614/75
Apr. 15, 1976 [GB] United Kingdom ..... 15579/76

[51] Int. Cl.[4] ..... G03C 1/76

[52] U.S. Cl. ..... 430/533; 430/271; 430/523; 524/423

[58] Field of Search ..... 430/533, 523, 271

[56] References Cited

U.S. PATENT DOCUMENTS

| | | | |
|---|---|---|---|
| 3,154,461 | 10/1964 | Johnson | 430/523 |
| 3,725,520 | 4/1973 | Suzuki et al. | 430/523 |
| 3,834,928 | 9/1974 | Tatsuta et al. | 430/523 |
| 3,853,584 | 12/1974 | Tatsuta et al. | 430/523 |
| 3,873,321 | 3/1975 | Tatsuta et al. | 430/523 |
| 3,944,699 | 3/1976 | Mathews et al. | 430/523 |

*Primary Examiner*—Jack P. Brammer
*Attorney, Agent, or Firm*—Cushman, Darby & Cushman

[57] ABSTRACT

Light-sensitive imaging materials comprise a white opaque oriented support film of a polyester, e.g. polyethylene terephthalate, containing a high amount of filler particles comprising barium sulphate, i.e. from 5 to 50% by weight, having an average particle size from 0.5 to 10 μm, and a light-sensitive imaging layer, e.g. a photographic emulsion, applied to the support film.

9 Claims, No Drawings

FILMS OF A LIGHT SENSITIVE ELEMENT HAVING A SUPPORT POLYETHYLENE TEREPHTHALATE CONTAINING BARIUM SULFATE PARTICLES

This is a continuation of application Ser. No. 921,817, filed Oct. 21, 1986, now abandoned, which is a continuation of Ser. No. 800,789, filed Nov. 22, 1985, now abandoned, which is a continuation of Ser. No. 444,182, filed Nov. 24, 1982, now abandoned, which is a continuation of Ser. No. 079,563, filed Sept. 27, 1979, now abandoned, which is a continuation of Ser. No. 890,803, filed Mar. 27, 1978, now abandoned, which is a continuation-in-part of Ser. No. 727,217, filed Sept. 17, 1976, now abandoned.

The present invention relates to light-sensitive imaging materials comprising film supports of synthetic polymeric materials containing finely divided inert inorganic particles.

Photographic prints are commonly produced upon a paper support coated with one or more light-sensitive photographic layers. Paper supports are fibrous in nature and tend to absorb the chemical solutions which may be employed in the development and fixing of the exposed print. If such chemicals are permitted to remain in the paper support, they tend to decompose and discolour the final print. It has therefore been common practice to wash such prints so as to purge the chemical residues from the paper support. Another known paper support is coated on both sides with a moisture impermeable layer, such as polyethylene, as a barrier against moisture and chemical penetration but the effectiveness of the barrier is limited by its susceptibility to scratching and moisture and chemical penetration via the uncoated edges of the support.

According to the present invention, a light-sensitive imaging material includes an opaque single-ply thermoplastics film support comprising a molecularly oriented film of a synthetic linear polyester in which finely divided particles consisting solely of barium sulphate are dispersed throughout the film, said particles of barium sulphate being present in an amount in the range 5 to 50% by weight based on the weight of the linear polyester and having an average particle size in the range 0.5 to 10 μm (microns), provided that the actual particle size of 99.9% of the particles does not exceed 50 μm (microns), and at least one light-sensitive imaging layer superimposed upon at least one surface of the film support.

The support films employed in the imaging materials according to this invention are highly impermeable to moisture and are therefore suitable for use as supports for photographic prints for which a substantial proportion of the washing operation which is normally employed for the treatment of prints upon paper supports may be eliminated.

Therefore a preferred embodiment of the invention relates to a photographic material such as a photographic print material which comprises an opaque single-ply thermoplastics film support comprising a molecularly oriented film of a synthetic linear polyester in which finely divided particles consisting solely of barium sulphate are dispersed throughout the film, said particles of barium sulphate being present in an amount in the range 5 to 50% by weight based on the weight of the linear polyester and having an average particle size in the range 0.5 to 10 μm, provided that the actual particle size of 99.9% of the particles does not exceed 50 μm, said film support being coated on at least one surface with one or more light-sensitive photographic emulsion layers.

The term "single-ply" used herein relates to films of unitary structure and does not relate to films comprising a multiplicity of layers, such as film laminates. Nevertheless, it is envisaged, according to this invention, that certain end-use functional coatings may be applied to one or both surfaces of the film, such as the photographic emulsion layers which are covered by the preferred embodiment described above.

The term "average particle size" used herein relates to that size of particle at which 50% by number of the particles in the particulate material have a size less than that size. Particle sizes may be measured by electron microscope, Coulter counter or sedimentation analysis and the average particle size may be determined by plotting a cumulative distribution curve representing the percentage of particles below chosen particle sizes.

It is preferred that none of the barium sulphate particles incorporated into the film support according to this invention should have an actual particle size exceeding 50 μm. Particles exceeding such a size may be removed by sieving processes which are known in the art. However, sieving operations are not always totally successful in eliminating all particles greater than a chosen size. Applicants therefore require that the size of 99.9% of the particles does not exceed 50 μm in circumstances where larger particles may unintentionally be included. Most preferably the size of 99.9% of the particles should not exceed 20 μm.

The synthetic linear polyester film support may comprise a self-supporting film of any suitable linear polyester, such as those polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such a pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful according to this invention.

According to this invention, the polyester film support contains finely divided particles of barium sulphate. Numerous inorganic particulate additives have been proposed in the art for addition to polymeric films. The film supports according to this invention have a high degree of whiteness and opacity, properties which are derived from the nature of the particulate additive itself, the relatively high amount of additive in the polyester, and especially the voiding which occurs around the additive particles when the film is stretched during molecular orientation. Other known particulate additives, such as titanium dioxide particles, do not produce voiding in polyester films during orientation by stretching. Such particles do nevertheless have a whitening and opacifying effect but this is inferior to the effect in the film supports comprising barium sulphate as employed according to the instant invention because of the absense of voiding. Even when titanium dioxide particles are employed in admixture with barium sulphate particles the whitening and opacifying effect is not so pronounced as when barium sulphate particles are used alone. In particular, the whiteness is inferior since the titanium dioxide particles impose a yellow colouration upon the film and also absorb ultra-violet light thereby rendering optical brighteners ineffective, whenever such are present. Accordingly, the instant invention is only concerned with film supports containing barium sulphate particles and no other particulate additive since such films have a pure white appearance. The light-sensitive imaging materials of the instant invention therefore produce images having excellent and true colour reproduction and are suitable for colour and black and white imaging. By contrast, images formed upon conventional film supports which are not pure white, e.g. having a yellow colouration, will be modified by the background colouration of the support and therefore not a true representation of the subject.

The film support included in the light-sensitive imaging material according to the instant invention has a whiteness value (measured ASTM test E-313-73) of at least 75 and preferably at least 80 and most preferably at least 90 and a negative yellowness value (measured by ASTM test D-1925-70).

Some other particulate conventional additives which may be incorporated into film polyesters by slurrying in the glycol from which the polyester is derived and it has been found that some of these cannot be slurried in sufficiently high amounts to provide adequate whiteness and opacity in the finished film. Some may produce reaction products with the polyester precursors, whilst others are not sufficiently white.

The barium sulphate employed according to this invention may be derived from naturally occurring or synthetic precipitated materials. Naturally occurring materials having an average particle size of about 2 μm and 99.9% of the particles not exceeding 10 μm and precipitated materials having an average particle size of about 1 μm and 99.9% of the particles not exceeding 3 μm are especially effective.

Amounts of barium sulphate of at least 7% and preferably in the range 10 to 25% by weight based on the weight of the linear polyester have been found to be particularly suitable for the production of opaque films, about 20% by weight being especially effective. It is preferred that the film support should have a glossy surface and this may be achieved when the barium sulphate particles have an average particle size not exceeding 5 μm and preferably not exceeding 2 μm. Decreasing particle size improves the gloss of the film support. Barium sulphate of average particle size of about 1 μm or even down to 0.7 μm produces film of satisfactory opacity and gloss. Particles having an average particle size in the range 4 to 6 μm provide a partially glossy or semi-matt surface.

Other additives, generally in relatively small quantities, may optionally be incorporated in the polyester film support, for example, optical brighteners, dyestuffs and polymeric additives.

Optical brighteners may be included in the polyester during production, e.g. by addition to the glycol, or alternatively by subsequent addition to the polyester prior to the formation of the film support, e.g. by injection during extrusion. The optical brighteners may be added in amounts up to 1500, preferably 500, parts per million based on the polyester. Suitable optical brighteners include those available commercially under the trade names 'Uvitex' MES, 'Uvitex' OB, 'Leucopur' EGM and 'Eastman' OB-1.

Dyestuffs in very small quantities, i.e. up to 10 parts per million based on the linear polyester, may be included in the polyester to slightly modify its colour.

Polymeric additives may also be incorporated into the polyester to increase voiding. Such additives should have a melting point less than that of the polyester and less than the temperatures employed for orienting the film support. The polymeric additives should be associated with the polyester as a loose blend or mixture in order that voiding should occur; intimate bonding between the polyester and the polymeric additives, such as chemical bonding, prevents voiding occurring. Mixtures of the polyester and polymeric additive produced by dry blending granules or powder thereof prior to formation of the film result in satisfactory voiding. Alternatively, the polymeric additive may be incorporated into the polyester during the production of the latter by addition to the polymerisation vessel, or by dispersion into the molten polyester during melt extrusion into film. Suitable voiding polymeric additives include polymers and copolymers of olefines, e.g. polyethylene, polypropylene and poly-4-methyl-1-pentene. Such olefine polymers and copolymers preferably include stabilisers against degradation at the temperatures employed for the polyester and/or film production. Standard commercial grades of stabilised polypropylene are effective in the film supports according to the invention. The polymeric additive, when employed, may be used in amounts of up to 40% by weight based on the weight of the linear polyester.

The oriented film supports may be produced by any known process for the production of oriented polyester films, such as those processes comprising melt extrusion through a slot die onto a cooled casting surface where the polyester is quenched to the amorphous state, molecularly orienting by stretching at an elevated temperature in one direction or two mutually perpendicular directions, followed by heat setting. Such a process is described in British specification No. 838 708. Whilst any of the draw ratios and drawing and heat-setting temperatures already known in the art may be employed in the production of film supports employed according to this invention, it has been found that higher draw ratios result in greater voiding and hence greater opacity. Greater voids are generally obtained when lower drawing and heat-setting temperatures are used. Biaxially oriented film supports of polyethylene terephthalate are preferably produced using draw ratios in the range 3.0:1 to 4.2:1 in each direction at drawing temperatures of about 90° C. and heat-setting temperatures of about 210° C.

Film supports having a matt or textured surface may be produced by quenching the molten polyester upon an embossed or textured casting surface or alternatively by any suitable surface treatment at a subsequent stage of the film production, e.g. by passing the film over a heated roll having an embossed or textured surface after orientation and heat setting have been effected.

The opacity of a film is thickness-dependent and may be assessed in terms of its total luminous transmission which may be measured by ASTM test method D-1003-61. Film supports, according to this invention, of thickness about 150 μm typically have a total luminous transmission not exceeding 20%, and preferably not exceeding 10% when measured by this test method. Film supports having a total luminous transmission of zero or in the region of zero, e.g. less than 5% can be derived by using barium sulphate additive particles in accordance with this invention and are the most preferred film supports for the production of light-sensitive imaging materials.

The film supports employed in the light-sensitive imaging materials according to this invention are opaque and white in appearance and have a paper-like nature. The light-sensitive imaging layer(s) applied to the film support may comprise one or more light-sensitive photographic emulsion layers such as gelatinous silver halide emulsions, including both monochrome and colour emulsions, diazotype layers which are sensitised with light-sensitive diazonium salts or light-sensitive vesicular layers. As already indicated above, a preferred embodiment of the invention relates to a photographic print material comprising one or more light-sensitive photographic emulsion layers. Prints may be produced from photographic materials in which the light-sensitive photographic emulsion layers comprise conventional monochrome emulsions or a multiplicity of conventional colour emulsions. Whilst the invention is especially concerned with photographic materials which are suitable for the production of photographic prints by means of conventional processing operations such as those employing conventional developing and fixing solutions, it also relates to photographic materials which are adapted for "instant" processing, i.e. processing shortly after exposing the material to light by a processing operation which takes place in the camera or soon after removing the exposed film from the camera. Such "instant" processing photographic materials may comprise a photographic material of the invention comprising the film supprt and one or more photographic emulsion layers applied thereto in association with a supply of processing chemicals. In conventional "instant" processing cameras, the processing chemicals are deposited upon the exposed photographic material during its removal from the camera. The "instant" processing photographic materials according to this invention may be processed in such a manner.

The light-sensitive imaging materials according to the invention, may be produced by the application of the light-sensitive imaging layer(s) to the film support by conventional treatments and coating operations. Where desired, known adhesion-promoting or subbing layers may be employed, especially when the light-sensitive imaging layer comprises a gelatinous photographic emulsion layer. For example, the adhesion of photographic emulsion layer(s) to the polyester film support may be developed by applying a polymeric subbing layer comprising any of the polymeric subbing compositions known for application to polyester film supports and, if desired, a conventional gelatinous subbing layer. One or more light-sensitive photographic emulsion layers of conventional composition for the production of photographic materials may be employed.

Prior to coating with the subbing and the light-sensitive imaging layers, it may be desirable to pretreat the film support surface to improve its adhesion to subsequently applied layers. The pretreatment may, for example, comprise treatment with a material having a swelling or solvent action on the film which does not affect the sensitometry of the photographic emulsion, such as a solution of one or more halogenated phenols in a common organic solvent. Such pretreating solutions may, if desired, include a polymeric component.

The treatment and coating of the film support may be carried out independently of the process for producing the film, that is after the film production has been completed. Alternatively, some or all of the treatments and coatings may be carried out during the process by which the film is produced. In particular, the film support may be coated with a polymeric priming or subbing layer during the process of film production, for example by applying such layers before orientation by drawing is commenced, or alternatively, when the film is biaxially oriented by stretching in two directions, the layers may be applied between the drawing operations employed in the two directions.

Photographic print materials produced according to this invention exhibit excellent image colour reproduction, as indicated above, excellent image stability without adverse sensitometric effects, and very sharp image definition.

The invention is further illustrated by the following examples.

EXAMPLE 1

Conventional film-forming polyethylene terephthalate containing 25% by weight, based on the weight of polyethylene terephthalate, of barium sulphate particles of average particle size 6 μm was extruded through a film-forming die and quenched upon a rotating cooled quenching drum to the amorphous state. The film was stretched at draw ratios of 3.3:1 first in the longitudinal direction and then in the transverse direction at a temperature of about 90° C. and heat set at about 207° C.

The properties of the resulting film support are shown in Table 1 and were such that the film was suitable for use as a support for photographic prints exhibiting strong adhesion to superimposed polymeric subbing and photographic emulsion layers without any adverse sensitometric effect.

TABLE 1

| Example | Film thickness μm | $F_5$ Kg $cm^{-2}$ | Modulus Kg $cm^{-2} \times 10^4$ | | Specific gravity | Total luminous transmission measured by ASTM test D-1003-61 % | Specular gloss measured at 45° by ASTM test D-2457-70 | Whiteness measured by ASTM test E313-73 |
|---|---|---|---|---|---|---|---|---|
| 1 | 130 | 705 | longitudinal | 3.19 | 1.32 | 8.5 | 15 | 80 |
| | | 725 | transverse | 3.21 | | | | |

EXAMPLES 2 TO 4

Film-forming compositions were prepared by dry bgnding granules of polypropylene which is commercially available as 'Propathene' PXC 3391 with granules containing polyethylene terephthalate and barium sulphate. The resulting compositions were as follows (parts being quoted by weight):

Example 2

Polyethylene terephthalate: 100 parts

Particulate barium sulphate (natural) of average particle size 2 μm, 99.9% of the particles not exceeding 12 μm: 22 parts
Propylene homopolymer: 4.1 parts Example 3

Composition of Example 5 plus
200 ppm of optical brightener which is available commercially as 'Leucopur' EGM Example 4

Composition of Example 5 plus
500 ppm of optical brightener which is available commercially as 'Leucopur' EGM The compositions were extruded through a film-forming die on to a rotating cooled drum to quench the polyethylene tetephthalate to the amorphous state. The resulting film supports were stretched sequentially at draw ratios of 3.2:1 in the longitudinal and transverse directions and at a temperature of about 90° C. and heat set at about 205° C.

The properties of the film supports are shown in Table 2. The film supports had excellent opacity and whiteness and were suitable for use as supports for photographic prints. The film supports of Examples 2 and 3 were pretreated to promote coating adhesion and coated with a polymeric subbing layer and a light-sensitive photographic emulsion. The coatings exhibited strong adhesion to the film support before, during and after processing in conventional photographic processing solutions.

The properties of the resulting film supports are shown in Table 3. The film supports had excellent opacity and were suitable for use as supports for photographic prints. A sample of the film support produced in Example 7 was pretreated with a halogenated phenol and coated with a polymeric subbing composition and a conventional photographic emulsion. The adhesion of the coatings to the film support before, during and after processing in conventional photographic processing solutions was strong and no adverse sensitometric effects were observed.

EXAMPLES 8 AND 9

Film-forming compositions were prepared by dry blending granules of polypropylene which is commercially available as 'Propathene' PXC 3391 with granules containing polyethylene terephthalate, barium sulphate and optical brightener. The compositions were as follows (parts being quoted by weight):

Example 8

Polyethylene terephthalate: 100 parts
Particulate barium sulphate (natural) of average particle size 2 μm, 99.9% of the particles not exceeding 12 μm: 19 parts
Propylene homopolymer: 4.2 parts
Optical brightener which is available commercially as 'Leucopur' EGM: 250 ppm Example 9

Polyethylene terephthalate: 100 parts

TABLE 2

| Example | Film thickness μm | $F_5$ Kg cm$^{-2}$ | Modulus Kg cm$^{-2}$ × $10^4$ | | Specific gravity | Total luminous transmission measured by ASTM test D-1003-61 % | Specular gloss measured at 45° by ASTM test D-2457-70 | Whiteness measured by ASTM test E313-73 |
|---|---|---|---|---|---|---|---|---|
| 2 | 115 | 685 | longitudinal | 2.87 | 1.14 | 8.7 | 22 | 85 |
| | | 770 | transverse | 3.54 | | | | |
| 3 | 120 | 690 | longitudinal | 3.19 | 1.08 | 7.3 | 22 | 108 |
| | | 770 | transverse | 3.36 | | | | |
| 4 | 110 | 680 | longitudinal | 3.04 | 1.13 | 8.2 | 22 | 116 |
| | | 775 | transverse | 3.38 | | | | |

EXAMPLES 5 TO 7

Film-forming compositions were prepared by dry blending granules of polypropylene which is commercially available as 'Propathene' PXC 3391 with granules containing polyethylene terephthalate, barium sulphate and optical brightener. The compositions were as follows (parts being quoted by weight):

Polyethylene terephthalate: 100 parts
Particulate barium sulphate (natural) of average particle size 2 μm, 99.9% of the particles not exceeding 12 μm: 22 parts
Propylene homopolymer: 4.1 parts
Optical brightener which is available commercially as 'Leucopur' EGM: 250 ppm The compositions were extruded into films and stretched by the procedure specified in Examples 2 to 4 using the draw ratios specified in Table 3 and heat set at about 210° C.

Particulate barium sulphate (synthetic) having an average particle size of 1 μm, 99.9% of the particles not exceeding 3 μm: 15 parts
Propylene homopolymer: 4.4 parts
Optical brightener which is available commercially as 'Leucopur' EGM: 250 ppm The film-forming compositions were extruded into films and stretched by the procedure specified in Examples 2 to 4 at draw ratios of 3.0:1 longitudinally and 2.9:1 transversely for both of Examples 8 and 9 and heat set at about 210° C.

The properties of the resulting film supports are shown in Table 3. The film supports had excellent opacity and whiteness and were suitable for use as supports for ptographic prints. The film support of Example 9 was pretreated to promote coating adhesion and coated with a polymeric subbing layer and a light-sensitive photographic emulsion. The coatings exhibited strong adhesion to the film support before, during and after processing in conventional photographic processing solutions.

TABLE 3

| Example | | Draw ratios | $F_5$ Kg cm$^{-2}$ | Modulus Kg cm$^{-2}$ × $10^4$ | Film thickness μm | Specific gravity | Total luminous transmission measured by ASTM test D-1003-61 % | Specular gloss measured at 45° by ASTM test D-2457-70 | Whiteness measured by ASTM test E313-73 |
|---|---|---|---|---|---|---|---|---|---|
| 5 | longitudinal | 3.2:1 | 610 | 2.70 | 140 | 1.11 | 5.8 | 26 | 108 |
| | transverse | 3.2:1 | 695 | 2.75 | | | | | |
| 6 | longitudinal | 3.0:1 | 620 | 2.80 | 145 | 1.14 | 7.0 | 17 | 113 |
| | transverse | 3.0:1 | 670 | 2.80 | | | | | |
| 7 | longitudinal | 3.2:1 | 635 | 2.85 | 145 | 1.11 | 6.4 | 18 | 112 |
| | transverse | 3.0:1 | 695 | 3.05 | | | | | |
| 8 | longitudinal | 3.0:1 | 580 | 2.70 | 150 | 1.12 | 6.8 | 19 | 111 |
| | transverse | 2.9:1 | 670 | 3.10 | | | | | |
| 9 | longitudinal | 3.0:1 | 750 | 3.65 | 130 | 1.33 | 9.0 | 24 | 119 |
| | transverse | 2.9:1 | 810 | 3.85 | | | | | |

EXAMPLES 10 to 14

A film-forming composition was produced by incorporating the various additives into polyethylene terephthalate during the production of the latter. The particulate barium sulphate was slurried in ethylene glycol and added to the reaction mixture for the production of the dimethyl terephthalate intermediate product. The optical brightener and polypropylene additives were added to the polycondensation mixture for the production of the polyethylene terephthalate component. The resulting film-forming composition was as follows (parts being quoted by weight):

Polyethylene terephthalate: 100 parts

Particulate barium sulphate (synthetic) of average particle size 1 μm, 99.9% of the particles not exceeding 3 μm: 18 parts Propylene homopolymer which is available commercially as 'Propathene' PXC 3391: 4.2 parts Optical brightener which is available commercially as 'Leucopur' EGM: 200 ppm The composition was extruded into films by the procedure specified in Examples 2 to 4 at the draw ratios specified in Table 4 and heat set at about 210° C.

The film supports so produced were suitable for use as supports for photographic prints. The film support of Example 11 was pretreated with a halogenated phenol and coated with a polymeric subbing layer and a light-sensitive photographic emulsion. The coatings exhibited strong adhesion to the film support before, during and after processing in conventional photographic processing solutions. No adverse sensitometric effects were observed.

TABLE 4

| Example | | Draw ratios | $F_5$ Kg cm$^{-2}$ | Modulus Kg cm$^{-2}$ × $10^4$ | Film thickness μm | Specific gravity | Total luminous transmission measured by ASTM test D-1003-61 % | Specular gloss measured at 45° by ASTM test D-2457-70 | Whiteness measured by ASTM test E313-73 |
|---|---|---|---|---|---|---|---|---|---|
| 10 | longitudinal | 3.2:1 | 730 | 3.35 | 125 | 1.25 | 4.1 | 34 | 87 |
| | transverse | 3.2:1 | 825 | 4.15 | | | | | |
| 11 | longitudinal | 3.2:1 | 740 | 3.45 | 120 | 1.26 | 5.0 | 33 | 87 |
| | transverse | 3.2:1 | 815 | 3.55 | | | | | |
| 12 | longitudinal | 3.5:1 | 675 | 2.85 | 110 | 1.19 | 2.6 | 37 | 88 |
| | transverse | 3.5:1 | 760 | 3.05 | | | | | |
| 13 | longitudinal | 3.7:1 | 695 | 2.80 | 110 | 1.15 | 2.1 | 39 | 90 |
| | transverse | 3.5:1 | 790 | 3.05 | | | | | |
| 14 | longitudinal | 3.5:1 | 680 | 2.85 | 120 | 1.17 | 2.3 | 35 | 89 |
| | transverse | 3.2:1 | 800 | 3.35 | | | | | |

EXAMPLES 15 TO 36

Polyethylene terephthalate of intrinsic viscosity (determined in a 1% by weight solution in ortho chlorophenol) 0.63 and containing 17% by weight of barium sulphate particles having an average particle size of 1.0 μm (99.9% of the particles not exceeding 3.2 μm) was extruded through a film-forming die and quenched upon a rotating cooled quenching drum to the amorphous state. The amorphous extrudate was stretched longitudinally and transversely at temperatures of about 95° C. using the draw ratios shown in Table 5 and heat set at a temperature of about 208° C. The film thicknesses and other properties are also shown in Table 5.

The resulting films were coated on one side with photographic subbing layers and light-sensitive gelatinous silver halide photographic emulsion layers. The applied layers adhered strongly to the film supports without any adverse sensitometric effect. Photographic images produced in the photographic emulsion layers exhibited excellent colour reproduction in both colour and black and white emulsions together with sharp image definition.

TABLE 5

| Example No. | Draw ratios MD × TD | Film thickness μm | Yield strength kg/cm² MD/TD | Break strength kg/cm² MD/TD | Specular gloss measured at 45° by ASTM test D-2457-70 Side 1/Side 2 | Total luminous transmission measured by ASTM test D-1003-61 % | Whiteness measured by ASTM test E-313-70 | Yellowness measured by ASTM test D-1925-70 |
|---|---|---|---|---|---|---|---|---|
| 15 | 3.4 × 3.3 | 200 | 843/914 | 1547/1476 | 30/35 | 1.9 | 100 | −4 |
| 16 | 3.4 × 3.4 | 188 | | | 31/34 | | 100 | −4 |
| 17 | 3.4 × 3.4 | 165 | | | 32/34 | 2.5 | 100 | −4 |
| 18 | 3.4 × 3.6 | 166 | | | | 2.2 | | |
| 19 | 3.3 × 3.5 | 170 | 860/907 | 1490/1760 | | | 101 | −5 |
| 20 | 3.4 × 3.5 | 176 | | | 32/32 | | 99 | −4 |
| 21 | 3.4 × 3.7 | 180 | 851/951 | 1460/1740 | 32/35 | 1.9 | 99 | −4 |
| 22 | 3.3 × 3.7 | 175 | | | 33/38 | | 99 | −4 |
| 23 | 3.3 × 3.7 | 169 | | | 34/36 | 2.0 | 99 | −4 |
| 24 | 3.4 × 3.7 | 175 | | | 32/33 | 2.1 | 101 | −5 |
| 25 | 3.4 × 3.7 | 175 | | | 34/35 | 2.3 | 100 | −5 |
| 26 | 3.4 × 3.7 | 175 | | | 33/36 | 2.3 | 101 | −5 |
| 27 | 3.4 × 3.8 | 112 | 858/956 | 1533/1835 | 33/34 | 3.7 | 101 | −5 |
| 28 | 3.3 × 3.8 | 118 | | | 32/32 | 3.7 | 100 | −5 |
| 29 | 3.5 × 3.8 | 112 | 848/927 | 1560/1740 | 42/42 | 3.2 | 97 | −5 |
| 30 | 3.5 × 3.8 | 123 | | | 38/39 | 3.1 | 97 | −5 |
| 31 | 3.5 × 3.8 | 116 | | | 40/40 | 3.2 | 96 | −5 |
| 32 | 3.5 × 3.8 | 120 | | | 40/40 | 3.3 | 97 | −5 |
| 33 | 3.5 × 3.8 | 118 | 835/928 | 1610/1750 | 38/38 | 3.3 | 97 | −5 |
| 34 | 3.5 × 3.8 | 119 | | | 38/39 | 3.4 | | −5 |
| 35 | 3.4 × 3.9 | 48 | 914/1050 | 1582/1954 | 35/38 | 9.2 | 102 | −5 |
| 36 | 3.4 × 3.9 | 42 | | | 37/37 | 10.4 | 101 | −6 |

Notation:
MD = longitudinal direction
TD = transverse direction

I claim:

1. A light sensitive imaging material, which includes an opaque single-ply biaxially oriented and heat set film of polyethylene terephthalate in which particles consisting of barium sulfate are dispersed throughout the film, said particles of barium sulfate being present in an amount in the range of 5 to 25% by weight based on the weight of the polyester terephthalate and having an average particle size in the range of 0.5 to 5 μm, provided that the particle size of 99.9% of the particles does not exceed 50 μm and at least one light-sensitive imaging layer superimposed upon at least one surface of the film support, said film support having a whiteness value of at least 90 and measured by ASTM test E-313-73 and having been biaxially drawn using draw ratios of 3.0:1 to 4.2:1 in each direction.

2. A material according to claim 1, in which the barium sulphate particles have an average particle size of down to 0.7 μm.

3. A material according to claim 1, in which the particles of barium sulphate are present in the film support in an amount of at least 7% by weight based on the weight of the polyester.

4. A material according to claim 1, in which the particles of barium sulphate are present in the film support in an amount in the range 10 to 25% by weight based on the weight of the polyester.

5. A material according to claim 4, in which the particles of barium sulphate are present in the film support in an amount of about 20% by weight.

6. A material according to claim 1, in which the barium sulphate particles have an average particle size of about 1 μm.

7. A material according to claim 1, in which the film support includes an optical brightener.

8. A material according to claim 1, in which the light-sensitive imaging layer(s) comprise light-sensitive photographic emulsion layer(s).

9. A material according to claim 8, in the form of a photographic print material.

* * * * *